United States Patent [19]

Mengshoel

[11] 4,377,309

[45] Mar. 22, 1983

[54] SUPPORTING DEVICE FOR USE IN A KNEELING-LIKE SITTING POSTURE

[76] Inventor: Hans C. Mengshoel, Bygdoey alle 12, Oslo 12, Norway

[21] Appl. No.: 48,785

[22] Filed: Jun. 15, 1979

[30] Foreign Application Priority Data

Jun. 19, 1978 [NO] Norway ..... 782144
Jun. 6, 1979 [NO] Norway ..... 791892

[51] Int. Cl.[3] ..... A47C 7/50

[52] U.S. Cl. ..... 297/423; 2/24; 5/443; 297/111; 297/195; 297/462

[58] Field of Search ..... 182/230; 297/4, 187, 297/423, 426, 430, 195, 111, 462, 423; 5/443; 2/24

[56] References Cited

U.S. PATENT DOCUMENTS

| | | | |
|---|---|---|---|
| 1,065,022 | 6/1913 | Bell | 297/423 UX |
| 1,402,698 | 1/1922 | Weingarten | 297/432 |
| 2,448,427 | 8/1948 | Gordon | 297/439 X |
| 2,480,406 | 8/1949 | Forney | 182/230 X |
| 2,484,494 | 10/1949 | Ferguson | 2/24 |
| 2,627,301 | 3/1953 | Emmett | 182/230 |
| 2,631,652 | 3/1953 | Bannister | 297/4 |
| 2,966,205 | 12/1960 | Blaschko | 297/111 X |
| 3,025,526 | 3/1962 | Ramon | 2/24 |
| 3,025,526 | 3/1962 | Ramon | 182/230 UX |
| 3,037,570 | 6/1962 | Olson | 297/423 |
| 3,084,458 | 4/1963 | Ramon | 2/24 X |
| 3,120,410 | 2/1964 | Berg | 297/439 X |
| 3,532,336 | 10/1970 | Baker | 5/443 |
| 3,541,313 | 11/1970 | Buzzi | 297/195 X |
| 3,604,023 | 9/1971 | Lynch | 5/443 |
| 3,669,493 | 6/1972 | Vowles | 297/429 |
| 3,863,978 | 2/1975 | Gillings, Jr. | 297/195 |
| 3,902,758 | 9/1975 | Pivacek | 297/430 |
| 3,908,198 | 9/1975 | Brock | 2/24 |
| 3,976,155 | 8/1976 | Esch | 297/426 X |
| 3,995,846 | 12/1976 | Frick | 5/443 |
| 4,090,268 | 5/1978 | Turner | 5/443 |
| 4,104,746 | 8/1978 | Goetz | 5/443 |

FOREIGN PATENT DOCUMENTS

| | | | |
|---|---|---|---|
| 961755 | 1/1975 | Canada | 297/423 |
| 970903 | 7/1975 | Canada | 5/443 |
| 832432 | 2/1952 | Fed. Rep. of Germany | 2/24 |
| 843232 | 7/1952 | Fed. Rep. of Germany | 2/24 |
| 2020658 | 11/1971 | Fed. Rep. of Germany . | |
| 2423040 | 11/1975 | Fed. Rep. of Germany . | |
| 122609 | 7/1971 | Norway . | |
| 413791 | 7/1934 | United Kingdom | 182/230 |

*Primary Examiner*—James T. McCall
*Attorney, Agent, or Firm*—Darby & Darby

[57] ABSTRACT

A supporting device for use in a kneeling-like sitting posture having means for simultaneously supporting the seat and ankle portions of the user. Means are also provided to support the leg portions of the user.

16 Claims, 19 Drawing Figures

SUPPORTING DEVICE FOR USE IN A KNEELING-LIKE SITTING POSTURE

The present invention relates to a supporting device for use in a kneeling-like sitting posture.

It is, particularly among the younger people, popular to sit or kneel on the floor in connection with various activities, among others having a meal at a low table. This posture is quite frequently rather exhausting for the leg and ankle portions if suitable support of the leg portions or parts thereof are not provided. This is particularly the case for people not particularly used to such a posture. It is often advantageous to assume a kneeling posture in carrying out a working operation at a table in order to obtain a suitable working posture. In many applications it is preferable to have a sitting angle greater than 90 degrees, a condition which is normally fulfilled when assuming a kneeling posture.

The prior art devices are, however, cumbersome to use. There are previously known various pieces of furniture of this kind, and Norwegian patent No. 122.609 discloses a device where the s ing surface is a saddle shape and where supporting means are provided on each side of the saddle to form rearwardly inclined faces for supporting the legs of the user. The user is forced to let the legs be at a relatively great distance from each other. In addition, the upper part of the body assumes a posture which makes it difficult to sit at e.g. a low table. A German Offenlegungsschrift discloses a similar piece of furniture as that in said Norwegian patent No. 122.609.

A further supporting device is known from U.S. Patent No. 2,627,301. Said patent discloses a cement finishing knee board intended to support cement finishers upon unset concrete in such a manner that their weight will be distributed over a wide area. Each board has a supporting face for the knee, a U-shaped leg supporting member for supporting a middle portion of the leg and a rear-supporting device for engagement with the shoe of the finisher. The said leg supporting means has a general U-shape in cross-section and is provided with strap means to ensure that the board is attached to the finisher upon movement in carrying out the necessary work.

Said board is, however, not suitable as a supporting device in a kneeling-like sitting posture, since the ankle portion of the user is not provided with any satisfactory support. Further it is impossible to move about in an upright position with such a board attached.

The present invention therefore has as its primary object to provide a supporting device for use in a kneeling-like sitting posture, said device being easy to manufacture and use.

According to the invention there is provided means for simultaneously supporting the seat and ankle portions of the user in such a manner that the leg portions of the user are forwardly and downwardly inclined relative to the horizontal. Further means may be provided for supporting the leg portions of the user, and said further means may be integral with said means for supporting the ankle portions of the user.

Means may also be provided for simultaneously supporting the seat and ankle portions of the user, said means being so designed as to be arranged about the ankle portion of the user. The said means may have a U-shaped or an O-shaped cross-section. Leg supporting means integral with said means may also be provided.

The inventive supporting device may be provided with means for simultaneously supporting the seat and leg portions of the user by letting said means for supporting the seat portion be provided by a stool known per se and said means for supporting the leg portions be provided by a cushion member connected to said stool by hinges or sliding elements.

The invention is now to be described by way of example of a preferred embodiment and modifications thereof, with reference to the attached drawings.

Figure 1:
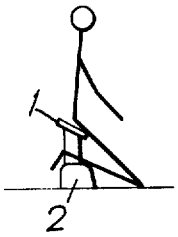
FIGS. 1 and 2 illustrate a first embodiment of the device according to the invention.
Figure 2:
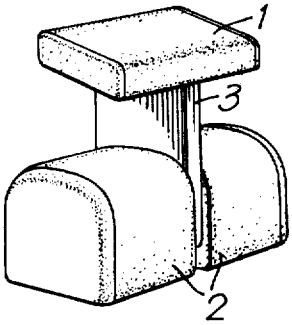

The device according to FIGS. 1 and 2 includes a frame 3 upon which is mounted a sitting face 1 for the seat portion of the user and supporting cushions or cushion 2 for supporting the lower leg portion of the user, as indicated in FIG. 1. The sitting face 1 may be made adjustable in a height. As it will appear from FIG. 1 it is the base, e.g. a floor, which supports the knee portion of the user. The frame 3 may possibly be made from a U-shaped member where the two free branches of the U are horizontal, one supporting the seat 1 and the other fixed to the cushion 2, as e.g. will be the case in FIGS. 8 to 12 to be discussed later.

Figure 3:
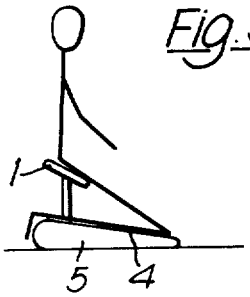
FIGS. 3 and 4 illustrate a second embodiment of the device according to the invention.
Figure 4:
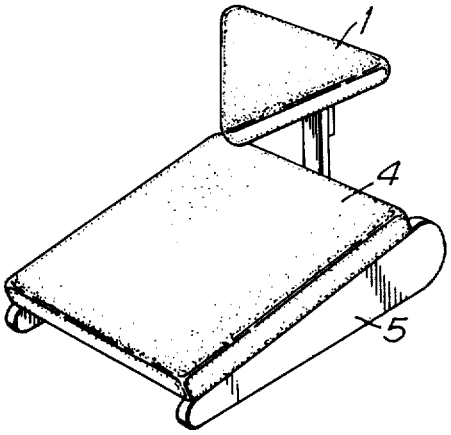

In FIGS. 3 and 4 the cushion 2 in FIGS. 1 and 2 has been replaced by a leg supporting cushion 4 which extends substantially over the complete length of the leg portion. The said cushion 4 is inclined downwardly and forwardly and is mounted on a sub-frame 5.

Figure 5:
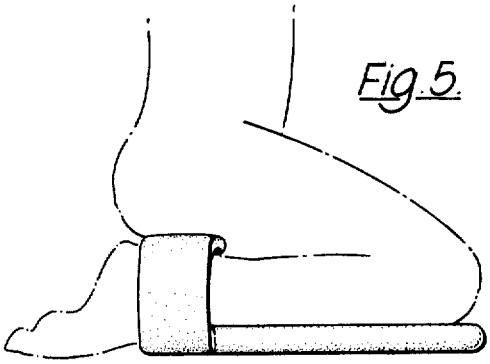
FIGS. 5 to 7 illustrate a third embodiment of the device according to the invention.
Figure 6:
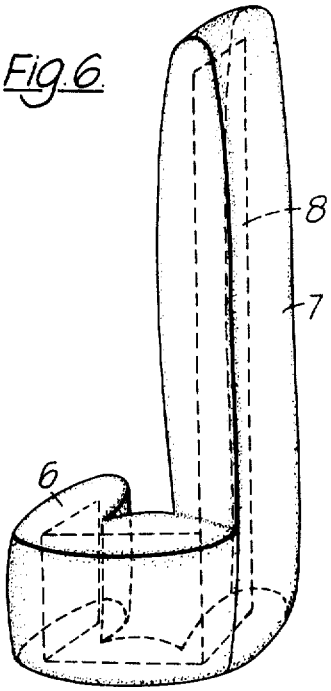
Figure 7:
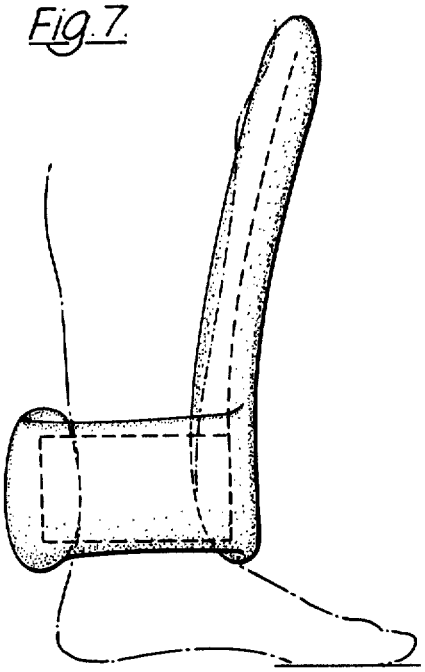
Figure 8:
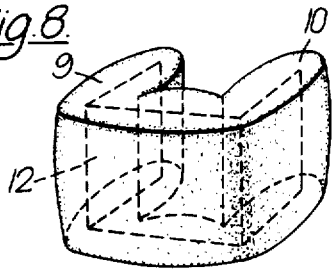
FIGS. 8 to 12 illustrate a fourth embodiment of the device according to the invention.
Figure 9:
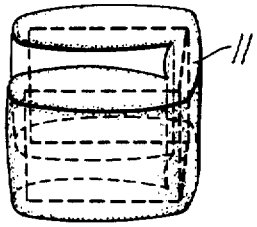

In FIGS. 5 to 7 the device is comprised by a L-shaped portion 6 and an oblong portion 7 which are united, preferably unitarily, to let the portion 6 together with one end of the portion 7 form a U-shaped portion intended to be arranged at the ankle of the user in order to let the device provide a good support at the intended posture both at the ankle and the remainder of the leg portion when the user kneels, as shown in FIG. 5. Even in the case when the user is standing, the device will remain on the leg, as indicated in FIG. 7. The device may be stiffened by an insert 8.

Figure 10:
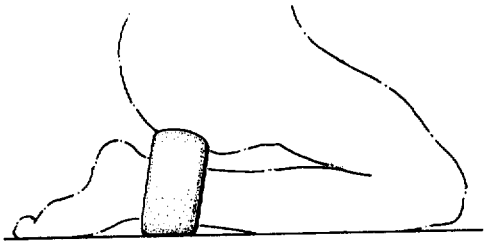
Figure 11:
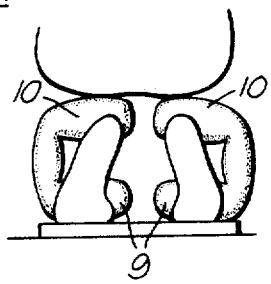
Figure 12:
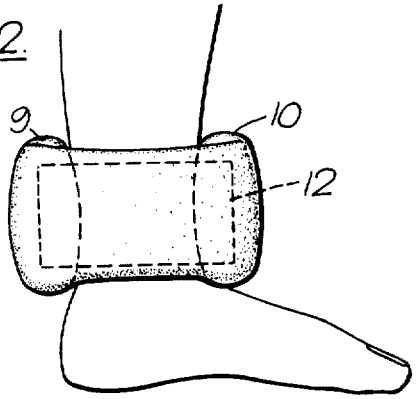

FIGS. 8 to 12 disclose a modification of the embodiment in FIGS. 5 to 7, said modification being particularly suitable where the base is soft, e.g. a carpet. The device has a U-shaped cross-section with free branches 9 and 10 and an intermediate branch 11 and a stiffening insert 12. As indicated in FIGS. 10 and 11 said device provides a good support of the seat portion and the ankle portion when the user assumes the kneeling-like sitting posture as indicated in FIGS. 10 and 11. The device will remain on the ankle, as in FIG. 12, by clamp action when the user is e.g. standing.

Figure 13:
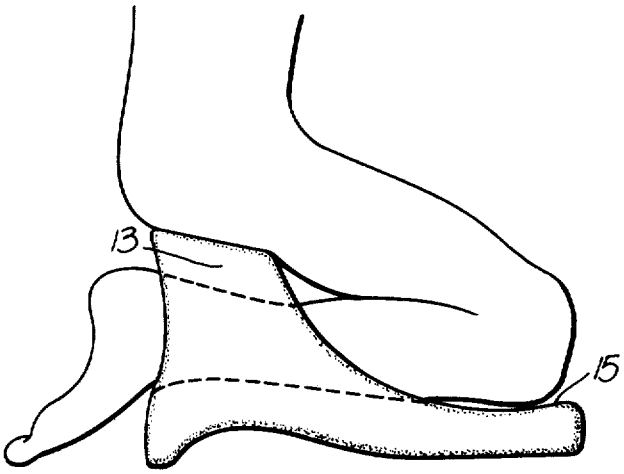
FIGS. 13 to 15 illustrate a fifth embodiment of the device according to the invention.
Figure 14:
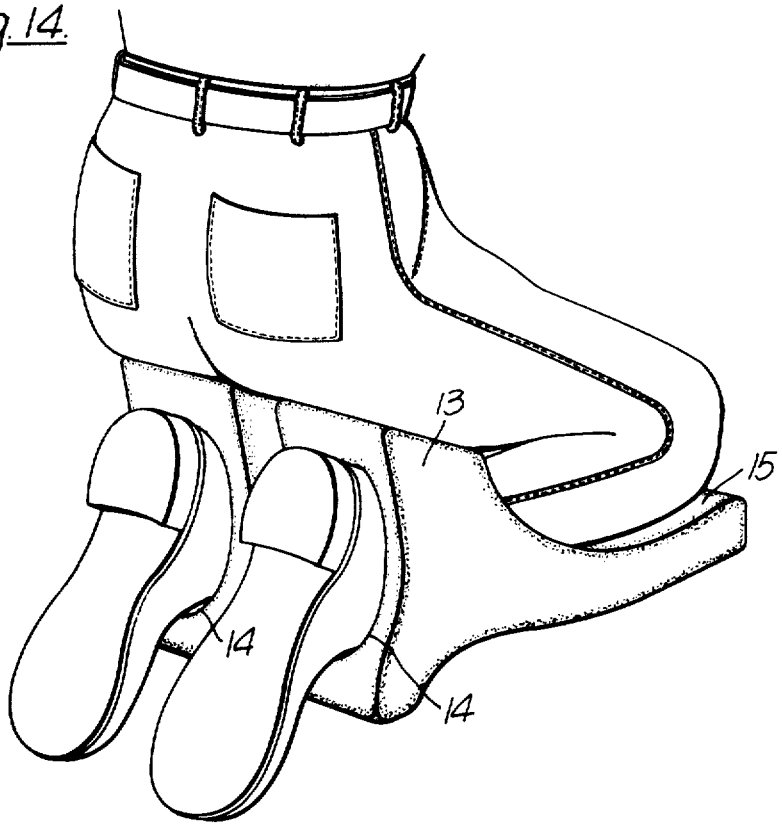
Figure 15:
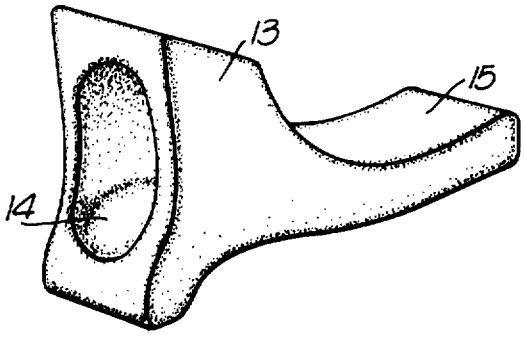
Figure 16:
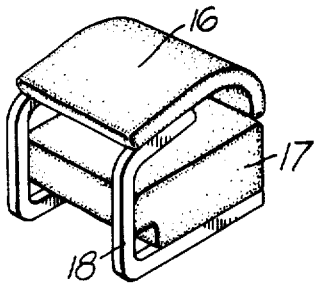
FIGS. 16 to 19 illustrate a sixth embodiment of the device according to the invention.
Figure 17:
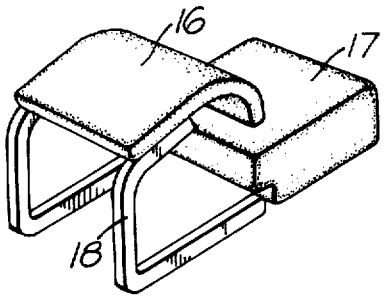
Figure 18:
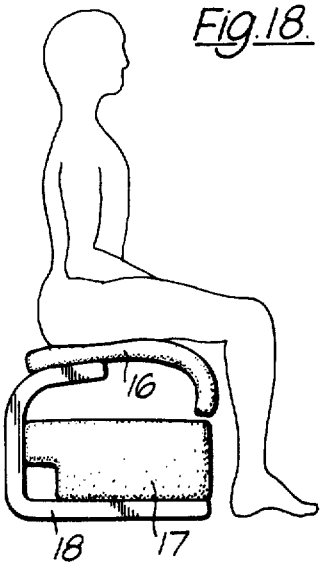

The embodiment in FIGS. 13 to 15 is a slight modification of the embodiment in FIGS. 5 to 7. The device is comprised by an ankle and seat supporting portion 13 having a passage 14 to enable the user to pass a foot therethrough. The portion 13 has a general O-shaped cross-section and completely surrounds the ankle portion of the user. A leg supporting portion 15 is unitarily connected to the portion 13.

In FIGS. 16 to 19 there is shown a stool 16 with a frame 18 to which a cushion member 17 is connected by hinges or sliding elements (not shown). In the situation illustrated in FIGS. 16 and 18 the user has assumed a conventional sitting posture.

Figure 19:
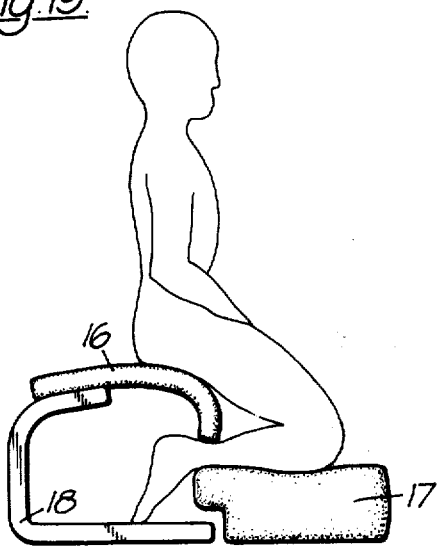

In FIG. 19 the user has assumed a kneeling-like sitting posture where the cushion member 17 has been pulled in front of the stool 16 to provide means for supporting the leg portions of the user.

As seen from the embodiments of FIGS. 1, 2, 3, 4, 13–15 and 16–19, the supporting means for the seat portion of the user is preferably forwardly and downwardly inclined.

I claim:

1. A device for supporting a human subject in a kneeling position comprising means adapted for simultaneously providing support for the ankle of each leg of the subject and for the subject's posterior, said support means including:

a first member having a bottom portion which is adapted for engaging and resting on a base surface and an upper portion adapted to engage the ankle of each leg of the subject to provide support for each ankle with respect to said base surface, and a second member separate from said first member and having a seat portion adapted for engaging and supporting the posterior of the subject while kneeling, said second member being formed with a storage section below its storage portions, said first member being storable in said storage section.

2. A device as in claim 1 wherein said second member comprises a seat having a frame as its bottom adapted for engaging and resting on said base surface, said frame extending forardly with its front end terminating to the rear of the front edge of said seat portion, and the lower portion of said first member having a recess which permits it to be moved toward the end of said frame with the upper portion of said first member extending close to the front edge of said seat portion.

3. A device as in claim 2 wherein the front of said seat portion is inclined downwardly.

4. A device as in claim 2 wherein said first member is a cushion.

5. A unit for each leg of a human subject for supporting the body in a kneeling-sitting position, each said unit comprising a cushioned member which can be worn while standing integrally formed with a first part and a second part extending therefrom and both parts defining an opening through which the ankle of the human extends to hold the device to the ankle, said first part for overlying the front of the ankle and having a lower surface for engaging a base surface to support the leg when the human is in a kneeling position, said second part overlying substantially only the rear of the ankle portion of the leg and extending outwardly from the ankle and having means when the human is kneeling and sitting on the outer surface thereof for engaging and supporting the posterior of the human in a sitting position.

6. A unit as in claim 5 wherein each said unit is generally C-shaped.

7. A unit as in claim 5 wherein the means of said second part for engaging and supporting the posterior is generally flat.

8. A device for supporting a human subject in a kneeling-like sitting posture in which the legs are bent at the knees comprising:

a base and a substantially flat seat, means for interconnecting said base and seat for simultaneously and respectively engaging and supporting the seat and ankle portions of the subject, said interconnecting means including an upwardly extending vertical member having is lower end connected to said base, said seat being connected to the upper end of said vertical member at generally the center thereof and being slanted downardly in such a manner that the thigh portions of both legs of the subject are forwardly and downwardly inclined relative to the horizontal, said seat having a portion cantilevered from each side of said vertical member, said cantilevered portions of the seat lying above ankle supporting portions of said base, said vertical member formed such that when a subject is on said seat and the ankles of the subject are engaging and being supported by said base an ankle of the subject is positioned on each side of said vertical member with the ankles positioned close to each other and to allow the knees of the subject to be close to each other, the ankle supporting portion of said base being shaped to allow the feet of the subject to be placed in a configuration such that a line joining the center of the heel to the center of the toe of each foot is generally in a vertical plane which is substantially perpendicular to the axis of the skin.

9. A device as in claim 8 wherein the upper surface of said base is shaped to support each ankle with respect to the ground surface such that only the part of each leg of the subject is engaged and supported by said base, each knee being permitted to rest on said ground surface.

10. A device as in claim 8 wherein the upper surface of said base is slanted upwardly from said ground surface and is sufficiently long that the highest part of the upper surface of said base is adapted for engaging the ankles of the subject and the lowest part of the upper surface of said base is adapted for having both knees resting thereon.

11. A device as in claim 8 wherein said seat and the upper surface of said base for engaging the ankles are both slanted in generally the same direction.

12. A device as in either of claims 9 or 10 wherein said upper surface of said base includes a cushion.

13. A device as in claim 5 wherein said first portions of said unit further comprises an elongated extension which extends toward the knee of the subject.

14. A device as in claim 13 wherein an extension is provided on the first part of said first portion which engages the base member to elevate the ankle relative to the knee from the base member.

15. A unit as in claim 6 wherein a said unit covers substantially only the ankle.

16. A unit as in either of claims 13 or 14 wherein said extension terminates below the knee-cap of the subject.

* * * * *